US007785133B2

(12) United States Patent
Wajcman

(10) Patent No.: US 7,785,133 B2
(45) Date of Patent: Aug. 31, 2010

(54) PHONO AND VIDEO PLUG ENGAGEABLE AT MULTIPLE ANGLES

(76) Inventor: Jzchak Wajcman, 862 Muirlands Vista Way, La Jolla, CA (US) 92037

( * ) Notice: Subject to any disclaimer, the term of this patent is extended or adjusted under 35 U.S.C. 154(b) by 0 days.

(21) Appl. No.: 12/354,767

(22) Filed: Jan. 15, 2009

(65) Prior Publication Data

US 2009/0181581 A1 Jul. 16, 2009

Related U.S. Application Data

(60) Provisional application No. 61/021,314, filed on Jan. 15, 2008.

(51) Int. Cl.
*H01R 11/20* (2006.01)

(52) U.S. Cl. ..... 439/412; 439/416

(58) Field of Classification Search ..... 439/411, 439/412, 416

See application file for complete search history.

(56) References Cited

U.S. PATENT DOCUMENTS

| | | | | | |
|---|---|---|---|---|---|
| 4,846,721 | A * | 7/1989 | Debruycker et al. | ..... | 439/411 |
| 5,069,636 | A * | 12/1991 | Shimirak et al. | ..... | 439/412 |
| 5,102,347 | A * | 4/1992 | Cote et al. | ..... | 439/412 |
| 5,791,919 | A * | 8/1998 | Brisson et al. | ..... | 439/166 |
| 6,149,469 | A * | 11/2000 | Kim | ..... | 439/668 |
| 6,428,351 | B1 * | 8/2002 | Turner et al. | ..... | 439/540.1 |
| 6,729,912 | B2 * | 5/2004 | D'Addario | ..... | 439/675 |
| 6,848,934 | B1 * | 2/2005 | McCarthy | ..... | 439/427 |

* cited by examiner

*Primary Examiner*—Truc T Nguyen
(74) *Attorney, Agent, or Firm*—Donn K. Harms

(57) ABSTRACT

A plug engageable to the distal end of a coaxial cable in either of an inline arrangement or a perpendicular engagement to the distal end. An axial spear automatically contacts the center conductor of the coaxial cable. The surrounding conductor is electrically engaged to the plug by a compression fitting or a screw.

2 Claims, 1 Drawing Sheet

PHONO AND VIDEO PLUG ENGAGEABLE AT MULTIPLE ANGLES

This application claims priority to U.S. Provisional Patent Application No. 61/021,314, filed Jan. 15, 2008, which is incorporated herein in its entirety by reference.

FIELD OF THE INVENTION

The disclosed device relates to a cable engageable plug. More particularly, it relates to a plug adapted to engagement to the distal end of coaxial cable commonly employed for audio and video transmission and also for coaxial style power plugs. The device allows for user engagement of the plug on the distal end of a coaxial cable which may be engaged at the user's choice, inline or at a ninety-degree angle. Additionally, a unique self cleaning tip embodiment may be provided to continually clean and remove dirt and corrosion from the female mating plug for the device.

BACKGROUND OF THE INVENTION

A jack plug or phono plug is a common audio connector. It is cylindrical in shape, with two or more contacts. Power supply plugs which generally communicate DC or low voltage AC from a small transformer to a device are also cylindrical in shape. Engageable audio style plugs were originally invented for use in telephone switchboards prior to electronic switching and are still widely used for audio and video transmission in the original ¼ inch size and in miniaturized versions adapted for engagement to smaller electronic components. A favorite use for such plugs is in the entertainment and music industry where guitars and amplifiers are connected with coaxial cable and various sound equipment is interconnected with patch cables having such plugs on both ends.

Power supply plugs with their barrel style engagement are made in numerous sizes depending on the voltage being delivered and the manufacturer. They generally have a hollow barrel for contacting a pin and a cylindrical exterior for providing a ground. Conventionally, these types of plugs are commonly employed to provide low voltage power to radios and clocks and computer equipment and such using the coaxial engagement of the power carrying circuit to avoid sparks and short circuits during connection.

Almost all electric guitars use a ¼ plug engageable in a mono jack (socket) as their output connector. Instrument amplifiers for guitars, basses and similar amplified musical instruments overwhelmingly employ such plugs as the standard mode of interconnection between the instrument and the electronic amplifier or other sound component receiving the output from the guitar. Loudspeaker outputs from amplifiers and foot switches and effects pedals also commonly use the ¼ plug engaged to the distal ends of coaxial cable for their interconnection. Other instruments such as keyboards and electronic drums employ the same configuration.

The interconnection of musical instruments, amplifiers, speakers, effects components, pedals and the like, by nature requires different length coaxial patch cables. Further, the angle of engagement of the cable to the plug is frequently required to be provided inline or at a ninety-degree angle to accommodate space and other considerations when interconnecting the equipment.

Factory produced audio cables and power cables, with plugs pre-installed at their distal ends, are not easily customized for angular engagement, nor length, since the plugs are conventionally soldered onto the distal ends of the audio or power cable. Consequently, users are frequently left with patch cables having the plugs engaged at an incorrect angle for the proposed connection and cables that are either too long or too short. Further, in the environment in which such patch cables are employed, dirt and corrosion can affect the sockets which engage the plugs and cause a loss of, or a distorted signal when engaged with the plug.

The disclosed device functions to allow an easily customizable solderless connection of a phono plug to the distal end of a coaxial cable or a power plug to the distal end of such a coaxial cable. While depicted as a ¼ inch phone plug, or in FIG. 6 as a ¼ inch coaxial power supply plug, the device can of course be used in ⅛ inch and other diameters just as easily.

The device has a novel means of engagement to the distal end of a coaxial cable that allows for both an inline engagement, or, a ninety-degree angle engagement of a single style of plug, on the distal end of the cable. In both types of engagement, the ground is communicated to the plug from the cable through a default insulation cutting by a set screw or collar during engagement to the distal end of the cable. The center conductor is also easily engaged prior to tightening of the set screw by employing a spear or pin type connection into the center wire of the coaxial cable. Consequently, the user can achieve an excellent electronic communicative connection on the distal end of the cable without the need to strip any insulation from the cable itself.

Using the provided plug-engageable collar having a center passage, an inline engagement to the plug is easily achieved. Just as easily achieved is a ninety-degree angle connection through an aperture in the side surface of the same plug and a seating of the collar into the plug. Optionally, a gnarled or otherwise abrasive surface on the exterior of the distal tip of the audio style plug can also be employed as a continuous means to clean the socket of debris and corrosion during use.

It is thus an object of the invention to provide a single phono plug that is engageable to the distal end of coaxial cable without stripping the insulation.

It is a further object of the invention to provide such a plug, in a single style, that provides both an inline and ninety degree angle engagement.

Yet another object of the invention is the provision of an abrasive surface on the plug to clean the socket in which it engages.

It is a further object of the invention to provide a single coaxial style power plug which is engageable to the distal end of coaxial cable, in either a straight line or ninety degree angle, without stripping the insulation.

With respect to the above description and background, before explaining at least one preferred embodiment of the invention in detail, it is to be understood that the invention is not limited in its application to the details of construction and to the arrangement of the components and/or steps set forth in the following description or illustrated in the drawings. The various apparatus and methods of the invention herein described and disclosed are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

DETAILED DESCRIPTION OF THE PREFERRED EMBODIMENTS

Figures 1, 2, 3, 4, 5, 6:
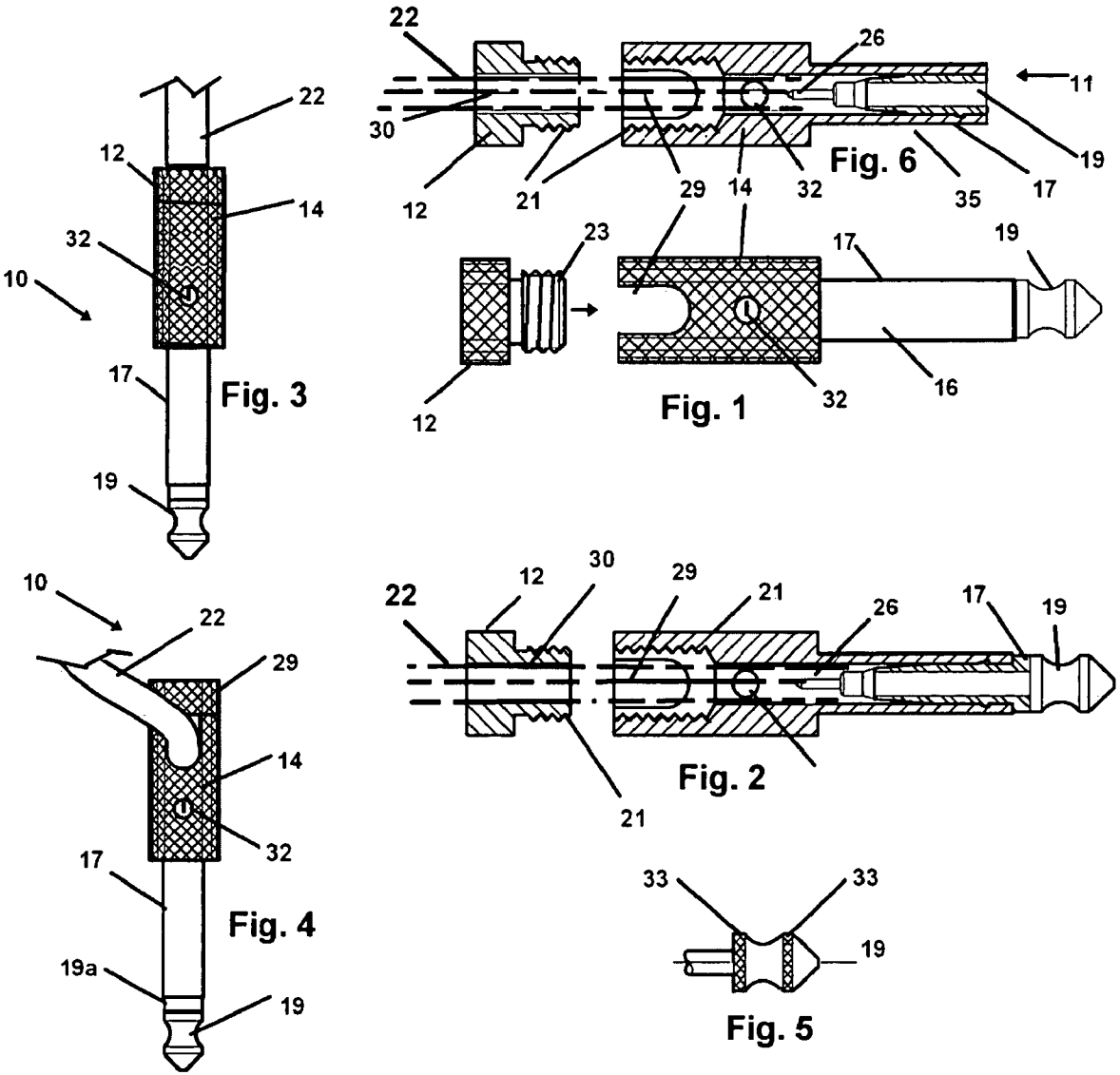
FIG. 1 depicts the device in an exploded side view.
FIG. 2 is sliced view of the device depicted in FIG. 1.
FIG. 3 depicts an inline engagement to a cable.
FIG. 4 depicts the same device engaged at a 90-degree angle.
FIG. 5 depicts an abrasive exterior surface on the plug adapted to clean an engaging socket of debris, dirt, and corrosion.
FIG. 6 depicts a sliced view of a coaxial power plug conventionally employed for providing transformer power to a small electric device.

As shown in FIG. 1, the device 10 employs an engageable collar 12 adapted for a threaded engagement into a body portion 14 of the device 10. Extending from the opposite side of the engagement of the collar 12 is the socket engageable plug 16 which as shown has two connectors 17 and 19 with each carrying a portion of a two-wire signal. Of course three wire and other multiple wire connectors exist and the device 10 can be adapted to those configurations and such is anticipated.

In both engagements shown in FIG. 3-4, the center conductor of the cable 22 is electrically engaged upon a spear 26 (FIG. 6) positioned axially inside the plug 16. The spear 16 thus allows for an electrical connection without stripping the cable 22.

As shown in FIG. 2 the collar 12 engages the body portion 14 (FIG. 1) with mating threads 21 on both components allowing for the collar 12 to screw into the body portion 14 and exert a compressive force on the cable 22 if engaged at a ninety-degree angle of FIG. 5. This compressive force allows a leading edge of the collar 23 to cut any insulation on the cable 22 and electrically engage the circular ground conductor of such cables 22 without stripping the insulation. With the spear 26 engaging the center conductor of the cable 22 both wires are thus electrically engaged to their respective parts of the device 10.

The ninety-degree engagement to the device 10 is provided by an aperture 29 through which the cable 22 is routed in a curved path to an engagement upon the spear 29. Once so engaged on the spear 26 the collar 12 is engaged into the body 14 and engages and cuts the cable insulation to make the electrical connection thereto.

The inline engagement as shown in FIG. 3 is achieved by threading the cable 22 through a passage 30 running axially through the collar 12. Once the center conductor of the cable 22 is engaged on the spear 26 a set screw 32 which is threadably engaged into the body 14 is twisted to compress into the cable insulation and electrically contact the ground thereof. This set screw 32 also doubles to hold the cable 22 to the device 10. Of course the collar 12 holds the cable 22 when engaged as in FIG. 4, and provides the ground, but the set screw 32 would best be employed when engaged in this fashion as a safety.

The plug as depicted in FIG. 6, functions in the aforementioned fashion as the phono plug style component but is a power supply plug 11. As depicted the coaxial cable engagement would function the same as with the phono plug version and would allow for engagement of any sized power plug on a coaxial cable in the same manner as phono plugs and yield either a straight line or ninety degree angle engagement. Different sized diameters of the barrel portion 35 can be provided to allow coaxial engagement to different sized receiving cavities. These different diametered power supply plugs 11 can be provided in a kit to allow the user to correctly engage the coaxial receiving cavity with the proper sized power supply plug 11.

As shown, the device 10 in the audio plug style and in the power plug style 11, is thus easily engaged by the user with either an inline, or ninety degree angle engagement, on the distal end of a coaxial cable 22 without the need to solder or strip the cable 22.

Finally, in the audio plug style of the device 10, an especially useful option is provided by the textured abrasive surface 33 which may be positioned circumferentially around the widest points on the positive connector 19. This connector 19 passes into the socket first and this abrasive surface 33 will thus clean the socket of dirt or corrosion or other material which might build on or be on the contacts of the socket.

While all of the fundamental characteristics and features of the phono plug for both inline and ninety degree angle engagement on a coaxial cable have been disclosed and described, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined herein.

What is claimed is:

1. A plug for electrical engagement to a distal end of a coaxial cable in either of an inline engagement or perpendicular engagement, comprising:

a body having a first end and a second end;

an internal cavity formed within said body;

said internal cavity communicating axially with said first end of said body at first aperture, said first aperture having a threaded sidewall;

a side aperture communicating with said internal cavity and with said first aperture, said side aperture defined by an edgewall;

a collar, said collar having an axial cavity communicating therethrough and a projecting threaded portion, said threaded portion configured for engagement with said threaded sidewall to position said collar to an engaged position with said body;

a cylindrical plug projecting from said second end, said plug having a first electrical connector at a distal end of said plug and a second electrical connector between said body and said first electrical connector;

said second connector electrically connected to said body;

said first connector electrically insulated from said body and said second connector;

an electrically conductive spear projecting axially into said internal cavity from said second end, said spear in electrical communication with said first electrical connector;

a screw having a first end adapted to pierce electrical insulation on a coaxial cable and a second end adapted for a tool;

said screw threadably engaged through said body in a direction traverse to said spear and having said first end in a communication with said internal cavity;

said plug having a first engagement direction wherein said distal end of said coaxial cable having a center conductor and a surrounding conductor, communicates with said internal cavity through said axial cavity of said collar in said engaged position;

said plug having a second engagement direction wherein said distal end of said coaxial cable communicates with said internal cavity through said side aperture when said collar is in said engaged position;

said center conductor in either of said first or second engagement directions electrically connected to said spear;

said surrounding conductor electrically engageable to said body by rotating said screw to pierce insulation on said coaxial cable and contact said surrounding conductor when said plug is in said first engagement direction;

said surrounding conductor electrically engaged to said body by a compression of said coaxial cable in a compressed engagement between a leading edge of said projected threaded portion and said edgewall;

said compressed engagement providing means to pierce said insulation on said coaxial cable and electrically engage said surrounding conductor to said body; and wherein a distal end of coaxial cable can be engaged to said plug in either of said first or second engagement directions with said center conductor electrically communicating with said first electrical connector and said surrounding conductor electrically communicating with said second connector.

2. The plug for electrical engagement of claim 1 wherein a portion of an external circumference of said first connector is configured to form an abrasive surface, said abrasive surface providing means to clean a surface of a mating electrical connector in a socket adapted to receive said plug.

* * * * *